United States Patent [19]

Berthet et al.

[11] Patent Number: 4,630,968

[45] Date of Patent: Dec. 23, 1986

[54] REALIZATION PROCEDURE OF A MODULAR SYSTEM PARTICULARLY SUITABLE FOR USE OFF COASTS

[75] Inventors: Hubert Berthet; Noël Laugier, both of Arles; Bernard Ricome, Carnon sur Mer, all of France

[73] Assignee: Institut Francais du Petrole, Malmaison, France

[21] Appl. No.: 661,931

[22] Filed: Oct. 17, 1984

[30] Foreign Application Priority Data

Oct. 17, 1983 [FR] France ..... 83 16482

[51] Int. Cl.[4] ..... B63B 35/44

[52] U.S. Cl. ..... 405/195; 114/264; 405/224

[58] Field of Search ..... 405/203, 204, 207, 205, 405/206, 195, 224; 114/265, 264, 65 R, 77 R

[56] References Cited

U.S. PATENT DOCUMENTS

| | | | |
|---|---|---|---|
| 3,641,774 | 2/1972 | Hekkanen et al. | 405/204 |
| 3,736,756 | 6/1973 | Lloyd | 405/204 |
| 3,802,673 | 4/1974 | Ross | 114/264 X |
| 3,879,952 | 4/1975 | Mo | 405/207 |
| 3,978,807 | 9/1976 | Nitzki | 114/264 |
| 4,007,598 | 2/1977 | Tax | 405/204 X |
| 4,087,984 | 5/1978 | Mo | 405/207 |
| 4,141,668 | 2/1979 | Engel | 405/204 X |
| 4,193,714 | 3/1980 | Gjerde | 405/204 |
| 4,217,848 | 8/1980 | Meyer-Haake | 114/264 |
| 4,234,270 | 11/1980 | Gjerde et al. | 405/203 X |

FOREIGN PATENT DOCUMENTS

| | | | |
|---|---|---|---|
| 892328 | 2/1972 | Canada | 405/204 |

*Primary Examiner*—Dennis L. Taylor

*Attorney, Agent, or Firm*—Antonelli, Terry & Wands

[57] ABSTRACT

The present invention concerns a realization procedure of a modular system particularly suitable for use off coasts, this system comprising a set of cylinders ($A_1$, $A_2$, $A_3$ . . . ) rigidly linked together, this set including at least one central cylinder ($A_1$) and a plurality of peripheral cylinders ($A_2$, $A_3$ . . . ).

This procedure includes the following successive stages:

the assembling together at the quay (8) of at least two peripheral first cylinders ($A_4$ and $A_5$), a joining of the central cylinder ($A_1$) to these two peripheral cylinders ($A_4$ and $A_5$), the placing in water of the unit constituted by the said central cylinder ($A_1$) and the said peripheral first cylinders ($A_4$ and $A_5$) and, the said unit being placed in the water, the joining of any remaining peripheral cylinders ($A_2$, $A_7$, $A_8$) to the said unit ($A_1$, $A_4$, $A_5$).

The invention can be advantageously used for the realization of a petrol production platform off coasts.

4 Claims, 14 Drawing Figures

FIG.2
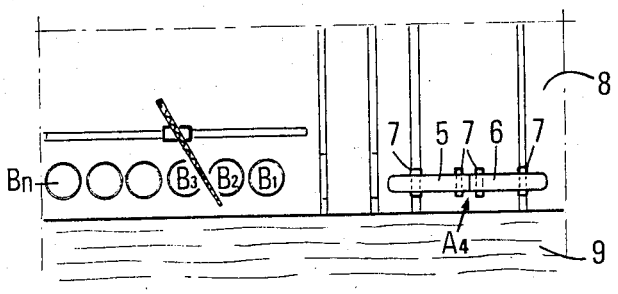
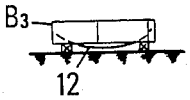
FIG.4A
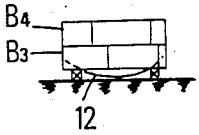
FIG.4B
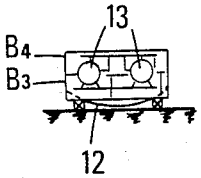
FIG.4C
FIG.3
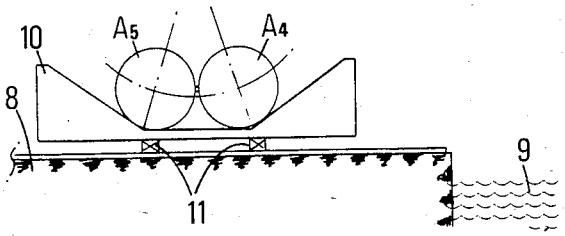
FIG.5
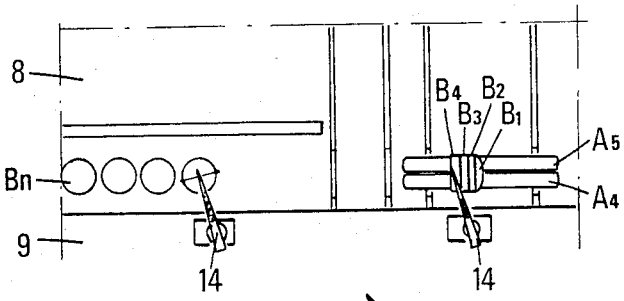
FIG.6
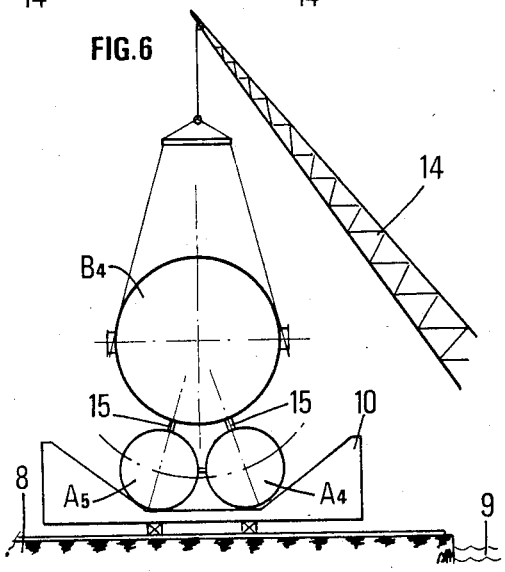
FIG.7
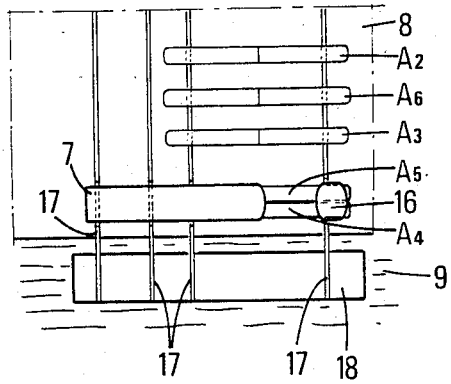

REALIZATION PROCEDURE OF A MODULAR SYSTEM PARTICULARLY SUITABLE FOR USE OFF COASTS

The present invention concerns a new procedure or method for constructing a modular system designed to be used off a coast, i.e., offshore, this system comprising an assembly made up of several cylinders.

Such a system is particularly suitable for use in the production, storing and loading of hydrocarbons offshore. A modular system of this type is described in the French patent application FR-A-No. 2.544.688 applied for on the 21st of Apr. 1983. The previous art can be illustrated by the U.S. Pat. Nos. 3,080,583 and 4,234,270.

The present invention provides a procedure or method for constructing a modular system particularly suitable for use off the coast, such a system consisting of a set of cylinders rigidly connected to each other, this set or assembly including at least one central cylinder and a plurality of peripheral cylinders.

The procedure according to the invention is characterized by the following stages:

(a) the joining together on a quay of at least two first peripheral cylinders, (b) the central cylinder is joined to these two peripheral cylinders, (c) the unit made up of the said central cylinder and at least the said first peripheral cylinders is placed in water, (d) the said unit being placed in the water, the joining is then carried out of any remaining peripheral cylinders to the said unit.

The assembling of the said first peripheral cylinders may be carried out on at least one support cradle.

The unit constituted by the two first cylinders can be placed in water by shifting, with or without the use of a platform.

According to the invention, it is possible to realize at least one of the cylinders through the assembling of several elements, these elements being fitted together on the quay.

When the main cylinder comprises several cylindrical elements, these can be joined one after the other directly to the said first peripheral cylinders as well as if required to the said first peripheral cylinders.

The process according to the invention, when applied to the case of a main cylinder including items of equipment, can include the assembling of the said items of equipment onto the cylindrical elements of the main cylinder before joining them together.

It is possible, according to the invention, to join at least a third peripheral cylinder to the unit constituted by the two first peripheral cylinders and the main cylinder before placing this unit in water.

In the case where the peripheral cylinders are joined to the main cylinder according to generatrices and where the peripheral cylinders extend beyond one extremity of the main cylinder, the procedure according to the invention may include the assembling of an annexe cylinder to the said two peripheral cylinders.

The present invention will be best understood and its advantages be more clearly apparent from the description of a particular example illustrated by the attached figures wherein:

FIG. 2 illustrates the production of a peripheral cylinder,

FIG. 3 shows the assembling of two peripheral cylinders,

FIGS. 4A, 4B and 4C show the assembling of the elements of the central cylinder A1, FIGS. 5 and 6 illustrate the placing of the central cylinder, FIGS. 7 to 10 show the placing of a part of the system onto a platform.

FIG. 1 represents a type of modular system, under the circumstances a production platform, which can be assembled according to the procedure described in the present invention.

Figure 1:
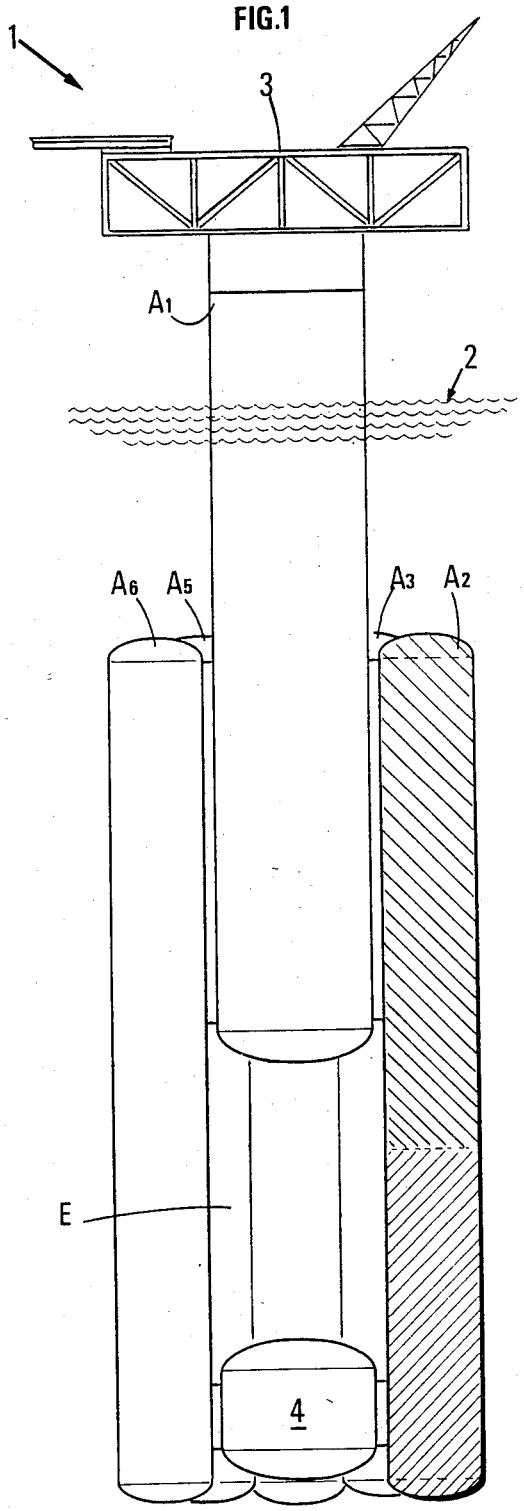
FIG. 1 represents a view of a platform comprising cylinders.

Reference 1 denotes the platform in its entirety. The latter includes a main metallic floating cylinder $A_1$, adapted to occupy a vertical position in service, the base of this cylinder being situated below the level 2 of the water. The upper part of the cylinder $A_1$ emerges in service above the level of the water and supports a bridge 3.

The main floating cylinder $A_1$ is surrounded with a ring of peripheral metallic cylinders $A_2$, $A_3$ . . . which descend below the cylinder $A_1$. This disposition releases under the floating cylinder $A_1$ a free space E limited by the ring of the peripheral cylinder $A_2$, $A_3$ . .

This free space E could possibly be used to accommodate devices such as an annexe cylinder 4 enabling the rigidity of the system to be increased and/or in order to lodge any sort of ballast there.

FIG. 2 represents the start of assembly operations.

FIG. 3 represents a peripheral cylinder $A_4$ comprising two elements 5 and 6 which are placed on cradles 7 and joined together by welding.

Reference 8 denotes a quay and reference 9 a basin.

FIG. 3 represents two first peripheral cylinders $A_4$ and $A_5$ which are assembled together and placed on a cradle 10. This cradle is possibly placed on sliding or rolling elements 11 from which will facilitate, at the appropriate time, the placing in water of a part of the system.

The main cylinder $A_1$ is joined to these two first cylinders $A_4$ and $A_5$.

This operation can be carried out by placing the cylinder $A_1$ directly onto the pheripheral cylinders $A_1$ and $A_4$ or by progressively assembling the different elements $B_1$, $B_2$, $B_3$ . . . $B_n$ which constitute this main cylinder $A_1$ as shown in FIGS. 5 and 6.

FIGS. 4A, 4B and 4C show an advantageous method of assembling the main cylinder $A_1$.

Certain of the elements $B_3$ and $B_4$ are assembled horizontally (FIG. 4B), the element $B_3$ comprising a bottom, then, if necessary, the items of equipment 13 are placed inside the elements $B_3$ and $B_4$.

The sub-assembly thus constituted by $B_3$, $B_4$ and 13 is carried by a crane 14 and joined to the first peripheral cylinders $A_4$ and $A_5$ and to the part of the main cylinder $B_1$, $B_2$ already in place.

The different cylinders can be assembled together thanks to possibly weldable link devices 15.

According to a particular realization mode, the ring of the peripheral cylinders $A_2$, $A_3$ . . . is rigidly fixed by welding to the main cylinder.

In order to facilitate the construction of such a modular system, it will be advantageous to incorporate with the ferrule 1 of each cylinder $A_1$, $A_2$, $A_3$ . . . a link device 15 at the time of manufacture of this ferrule, the assembling of two neighbouring cylinders being then carried out by welding between the link devices 15 which are provided with these cylinders.

FIG. 7 shows the unit made up of the two first peripheral cylinders $A_4$ and $A_5$ and the main cylinder $A_1$.

This unit can be fitted with a reinforcement device such as an annexe cylinder 16 serving to stiffen the final structure.

Figure 8:
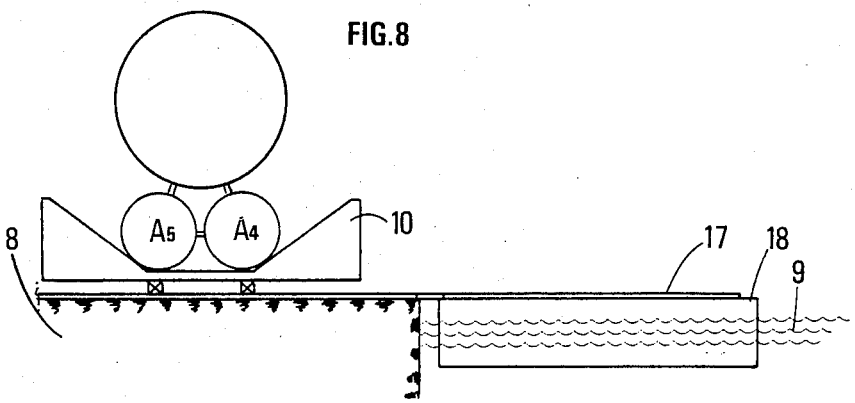

Ramps 17 are set up linking the quay 8 to a platform 18 (FIGS. 7 and 8).

The cradle 10 supporting the unit $A_1$, $A_4$, $A_5$ is displaced, possibly by shifting, in order to be placed on the platform 18.

Figure 10:
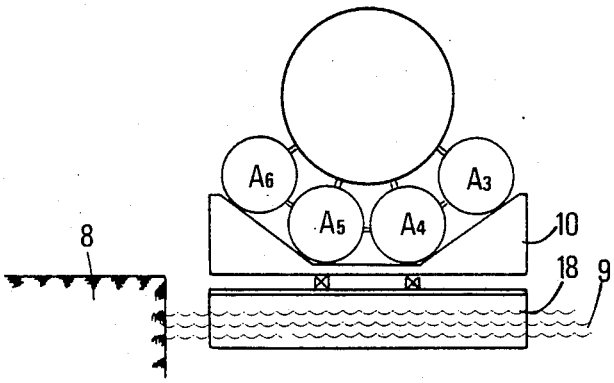

Peripheral cylinders $A_3$ and $A_6$ can be joined to the unit made up of the two first peripheral cylinders $A_4$ and $A_5$ and the main cylinder $A_1$ in order to provide a better stability in the water for the unit thus constituted (FIG. 10).

Figure 9:
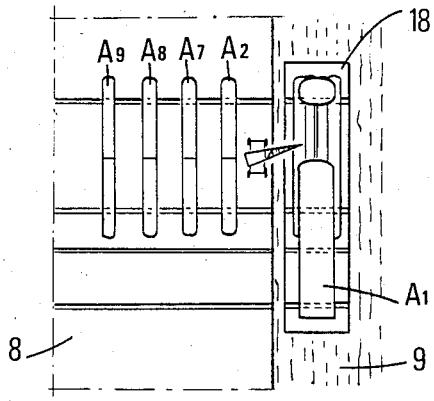

These cylinders $A_3$ and $A_6$ can be placed in position, either when the unit is still on the quay or when it is placed on the platform 18 (FIG. 9).

In this last instance, the platform could be turned 180° in order to allow the peripheral cylinders to be put in position.

Figure 11:
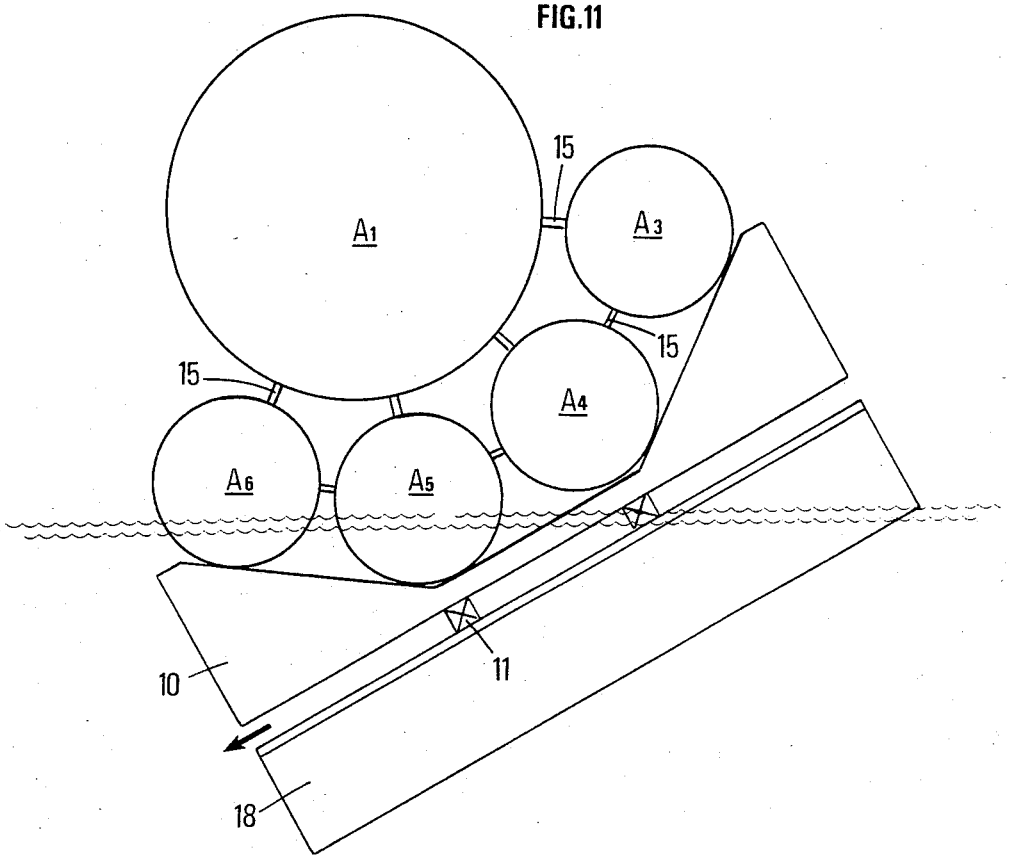
FIG. 11 illustrates the tilting of the platform and the placing into the water of one part of the system.
Figure 12:
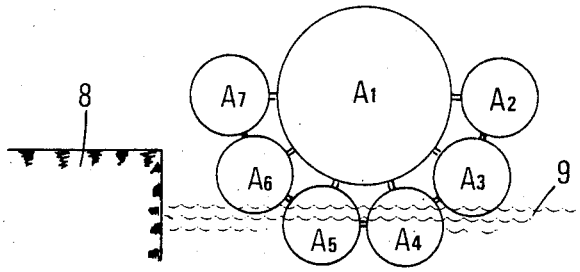
FIG. 12 shows the assembling of the remaining peripheral cylinders.

The platform 18 is then tilted or possibly immersed by ballasting or liquid filling so as to enable the new unit $A_1$, $A_3$, $A_4$, $A_5$, $A_6$ (FIG. 11) to be placed in the water. In FIG. 11, the tilting of the platform is done laterally. It is quite obvious that the said tilting could be carried out in another direction, in particular longitudinally.

The assembling of the peripheral cylinders $A_2$, $A_7$ . . . is continued whilst the unit is in the water.

Of course, this assembly operation in the water does not take place if all the peripheral cylinders have been assembled on the quay or on the platform.

One would not be departing from the framework of the present invention by effecting the placing in the water of one part of the system without using the platform, as this is moreover done for the launching of vessels.

The establishment of this system on the chosen site could be advantageously effected by separately towing the unit of cylinders (FIG. 2) and the floating bridge, for example thanks to platforms. By ballasting certain cylinders, the unit of cylinders is tilted in a vertical position and connection on the site is then carried out between the bridge remaining horizontal and the unit of cylinders in vertical position.

This connection can be made by ballasting certain cylinders by placing the bridge perpendicular to the main cylinder, then by deballasting these cylinders.

We claim:

1. A method for constructing a modular system suitable for use offshore, said system comprising a set of cylinders ridiidly linked together, said set comprising at least one central cylinder and a plurality of peripheral cylinders, said method comprising the following successive stages:

(a) joining together, on a quay, at least two first peripheral cylinders, said two peripheral cylinders being carried out on at least one support cradle;

(b) joining the central cylinder to said at least two first peripheral cylinders to form a unit of assembled cylinders;

(c) placing the unit of a assembled cylinders in the water; and (d) after said unit is placed in the water, further joining any remaining peripheral cylinders of said plurality of cylinders to said unit.

2. A method according to claim 1, wherein said central cylinders is made up of several cylindrical elements which are assembled together onto said at least two peripheral cylinders and the central cylinder comprises items of equipment for use in an offshore location and cylindrical elements which, when assembled, form said central cylinder, said items of equipment being mounted on the cylindrical elements before the elements are assembled together to form said central cylinder.

3. A method according to claim 1, wherein the peripheral cylinders are joined to the central cylinder within a space defined by lines generated by a generatrix from the axis of said central cylinder and wherein the peripheral cylinders are arranged to extend beyond one of the extremities of the central cylinder, further comprising joining an annex cylinder to said peripheral cylinders.

4. A method according to claim 1, further comprising an intermediate stage between stages (b) and (c) wherein additional peripheral cylinders are joined to the unit made up of said central cylinder and said at least two first peripheral cylinders before the unit is placed into the water.

* * * * *